US005362050A

United States Patent [19]

Matsuyama

[11] Patent Number: 5,362,050

[45] Date of Patent: Nov. 8, 1994

[54] MOVABLE BODY JUMPING MECHANISM FOR AMUSEMENT DEVICES

[75] Inventor: Yasushi Matsuyama, Tokyo, Japan

[73] Assignee: Tomy Company, Ltd., Tokyo, Japan

[21] Appl. No.: 124,546

[22] Filed: Sep. 22, 1993

[30] Foreign Application Priority Data

Sep. 25, 1992 [JP] Japan ..... 4-072917[U]

[51] Int. Cl.[5] ..... A63F 3/00

[52] U.S. Cl. ..... 273/118 R; 273/108; 273/109; 273/129 R

[58] Field of Search ..... 273/108, 109, 113, 115, 273/118–121, 123, 124, 129 R

[56] References Cited

U.S. PATENT DOCUMENTS

| | | | |
|---|---|---|---|
| 3,901,511 | 8/1975 | Garbark | 273/119 A |
| 4,148,486 | 4/1979 | Tepper | 273/124 R X |
| 4,311,311 | 1/1982 | Crosman | 273/121 A |
| 4,840,375 | 6/1989 | Lawlor et al. | 273/121 BX |
| 4,968,031 | 11/1990 | Kaminkow et al. | 273/119 A X |

FOREIGN PATENT DOCUMENTS

| | | | |
|---|---|---|---|
| 294923 | 12/1988 | European Pat. Off. | 273/119 A |

*Primary Examiner*—Vincent Millin

*Assistant Examiner*—Raleigh W. Chin

*Attorney, Agent, or Firm*—Staas & Halsey

[57] ABSTRACT

An amusement device has a movable body, a game board and a jumping mechanism. The game board has a surface large enough to accommodate movement of the moveable body in a plane of movement, which surface has first and second play areas. The jumping mechanism moves the movable body out of the plane of movement and also moves the movable body from the first play area to the second play area. The jumping mechanism includes a conical member, a sloped movable body passage and a movement mechanism. The conical member extends out of the game board and has upper and lower portions. The conical member is positioned within the first play area with the lower portion being closer to the game board than the upper portion. The conical member has a movable body outlet in the upper portion and a movable body inlet in the lower portion. The movable body passage has first and second ends with the first end being positioned in the vicinity of the movable body outlet and the second end being positioned in the vicinity of the second play area. The movement mechanism moves the movable body from the movable body inlet to the movable body outlet.

6 Claims, 7 Drawing Sheets

MOVABLE BODY JUMPING MECHANISM FOR AMUSEMENT DEVICES

BACKGROUND OF THE INVENTION

1. Field of the Invention

The present invention relates generally to a game device having a movable body, for example, a ball, which is moved along a game board, and more particularly, to a game device constructed so as to enable the movable body to automatically jump on the game board.

2. Description of the Related Art

The typical pinball game device of the related art includes bumper mechanisms for automatically rebounding a ball which rolls along a game board and collides therewith. The typical pinball game device also has flippers with which a player can try to direct the ball. In this pinball game device, the ball is repeatedly rebounded by the bumpers and the flippers, and is irregularly moved along the game board. During this movement, whenever the ball collides with a bumper mechanism, a counter counts a score. Obtaining a high score is the object of the game.

However, in the related art pinball game device, the ball is moved in a simple plane along the game board. Although the movement is irregular because of the bumpers and flippers, the movement is relatively simple. This brings about a disadvantage in that one cannot enjoy a jumping movement of the ball.

SUMMARY OF THE INVENTION

In view of the above disadvantage, the present invention has been made, and an object of the present invention is to provide a game device capable of moving a movable body in three dimensions along the game board so that visual enjoyment of the ball movement is enhanced.

To achieve the above object, according to the present invention there is provided a game device for playing a game by moving a movable body along a game board, the game board having a plurality of play areas. A jumping mechanism is provided for jumping the movable body from a first play area to a second play area.

The movable body is preferably a ball. Further, the above jumping mechanism preferably includes a conical member which has an inlet for receiving movable bodies from the first play area. In this case, the conical member would be rocked in semicircle with respect to the game board to an outlet, causing the movable body to move to the top of the conical number. The jumping mechanism preferably also includes a ball passage for receiving the movable member. One end of the ball passage is near the top of the cone and the other end is near the second play area. This allows the movable body to be moved from the top of the conical member to the second play area.

In addition, the second play area preferably has a lucky zone in which a relatively high number of game points are scored when the movable body is moved thereto.

According to the above game device, the movable body moved in the first play area on the game board jumps to the second play area via the jumping mechanism. Further, when the movable body is embodied as a ball, the present invention can be configured, for example, as a pinball game.

When the movable body moves to the first play area on the game board, it enters the base of the conical member of the jumping mechanism from a movable body inlet on the side surface of the jumping mechanism. The movable body is then rolled and raised along the inner surface of the conical jumping mechanism via the centrifugal force due to rocking of the jumping base. The movable body is thus flung away from the outlet, exiting the conical member. The ball passage of the jumping mechanism then transports the movable body to the second play area. Further, since the second play area to which the ball is moved may comprise a lucky zone permitting a high game score, it is possible to visually enjoy the jumping movement of the movable body and also to expect subsequent high scoring. That is, the present invention adds competitiveness and enhances enjoyment of the game more.

DETAILED DESCRIPTION OF THE PREFERRED EMBODIMENTS

Hereinafter, a preferred embodiment of the present invention will be described in detail with reference to the drawings.

Figure 1:
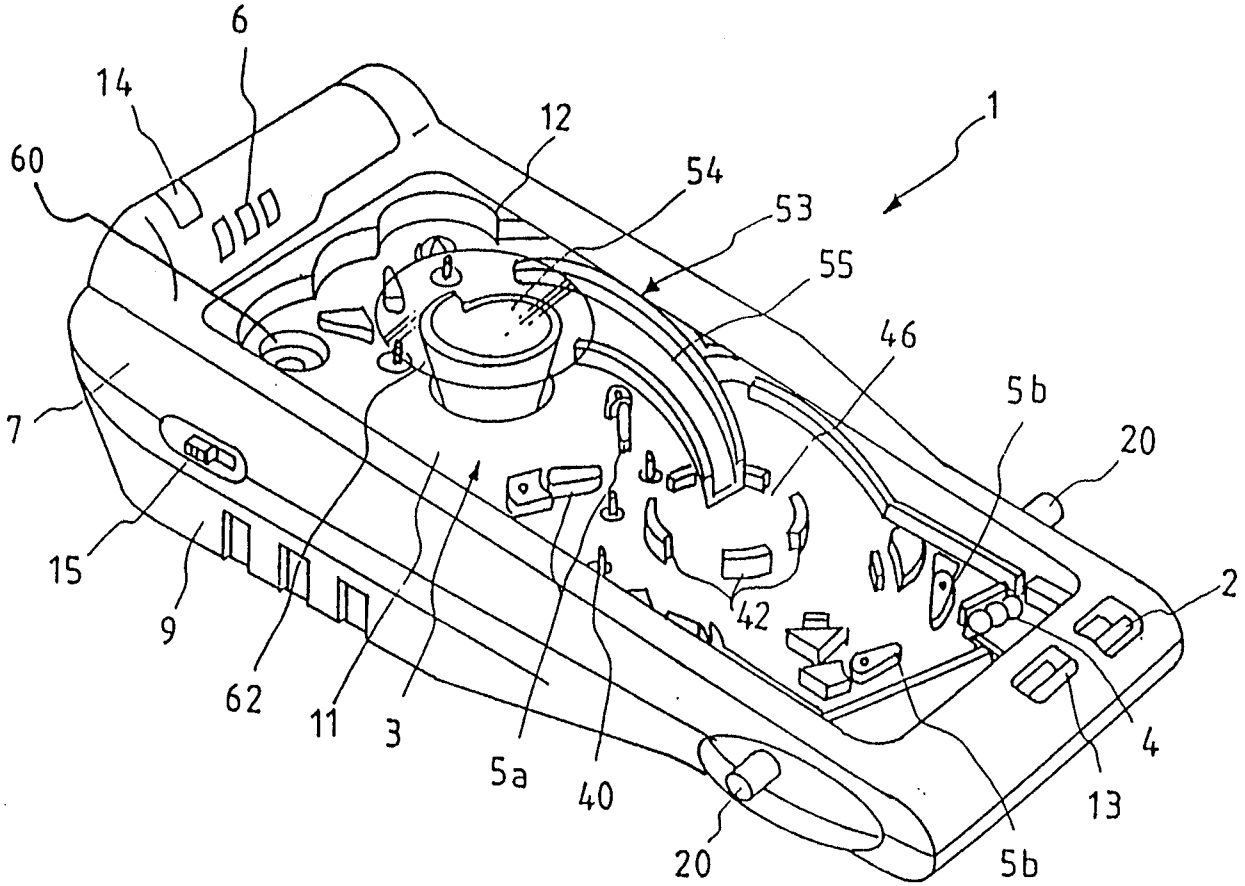
FIG. 1 is a perspective view showing the external appearance of a pinball game device according to the present invention.

FIG. 1 is a perspective view showing the external appearance of a pinball game device embodying the present invention. The pinball game device 1 is of a relatively small table top type, and operates as follows. First, a player propels a ball 4 by operating a discharge lever 2. The ball 4 then rolls on the game board 3. Upper and lower flippers 5*a*, 5*b* can be used to deflect the ball 4 from its course. In this case, whenever the ball 4 collides with a member on the game board 3, a counter 6 counts and displays a specified score. The game is based on achieving the highest total score. Further, in this game device 1, a jumping mechanism 53 having a conical member 54 and a ball passage 55 is provided on the game board 3 for jumping a ball 4 which is rolled to and received by jumping mechanism board 53.

Figure 4:
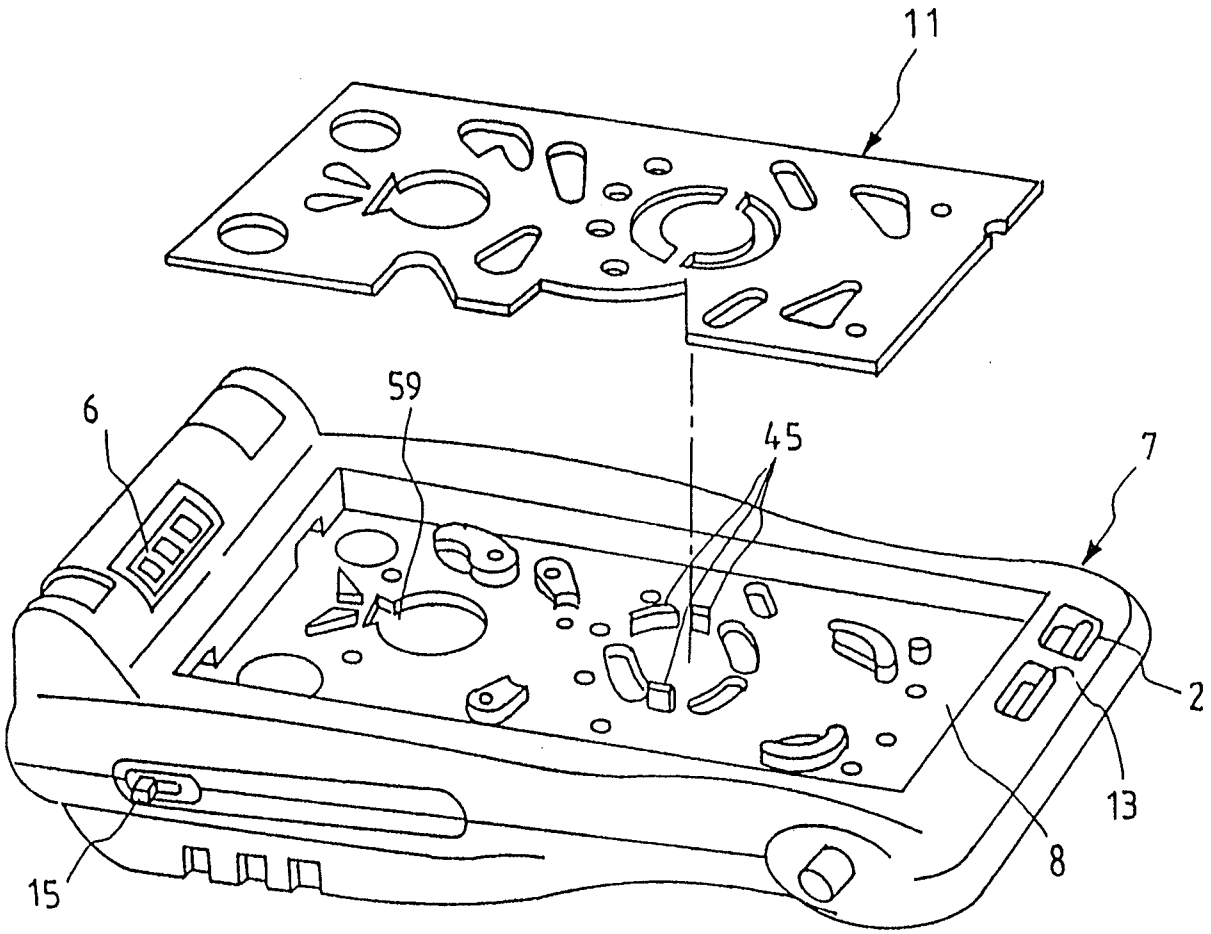
FIG. 4 is a perspective view showing the base, a main body and a surface layer plate.

The pinball game device 1 includes on its periphery an operating member, such as a discharging lever 2, and a counter 6. It further includes at its central portion a main body 7 formed of an inclined bottom plate 8 (see FIG. 4) constituting a game board 3; a base 9 (see FIG. 2) fixed on the underside of the main body 7; a surface layer plate 11 laid on the bottom plate 8 of the main body 7, which constitutes the game board 3 together with the bottom plate 8; and a transparent cover 12 made of, for example, plastic for covering the game board 3. The balls 4, each being made of steel, are contained within the main body 7. For example, there may be three balls.

The main body 7 is made of, for example, plastic. It includes, on its peripheral wall, a gate stopper 13 for preparing the balls 4 to be discharged by the discharging lever 2, the counter 6 (described above), a counter reset button 14 for resetting the counter 6 and a main switch 15. Holes are formed in the plate 8 and the surface layer plate 11 of the main body 7. The holes have shapes approximately similar to the elements (to be described later) formed on the rocking plate 10. The holes are formed at positions corresponding to the elements (see FIG. 4).

Figure 3A:
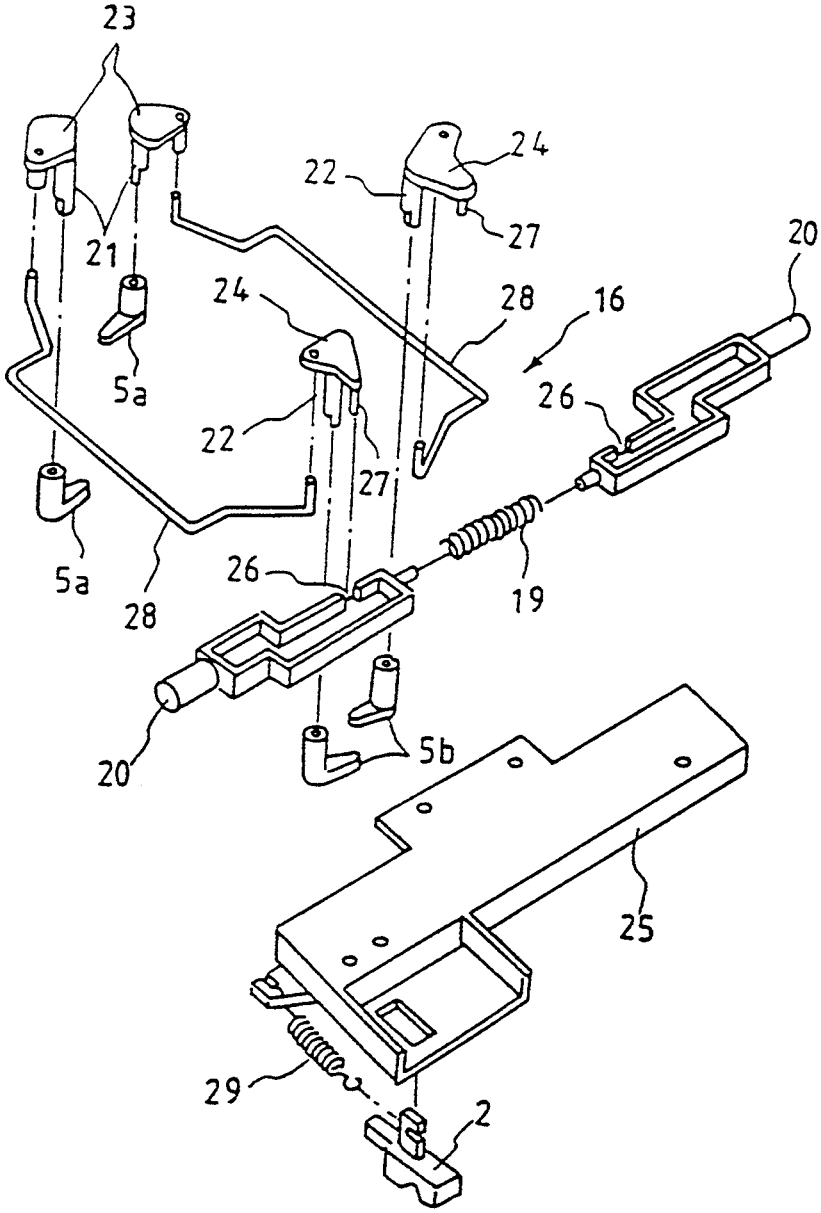
FIG. 3A is an exploded perspective view of flippers and a drive mechanism.
Figure 3B:
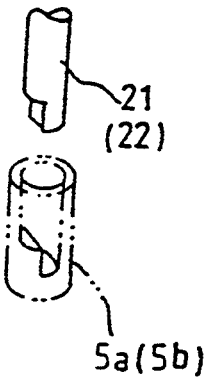
FIG. 3B is a perspective view showing how a shaft meshes with one of the flippers.

FIG. 3A shows from below the flippers 5*a*, 5*b*, and a drive mechanism 16. As shown in this figure, the flippers 5*a* and 5*b* are comprised of a pair of right and left upper flippers 5*a*, disposed at the central portion of the bottom plate 8, and a pair of right and left lower flippers 5*b* disposed to one side of the bottom plate 8. The drive mechanism 16 includes a pair of right and left flipper levers 20 disposed such that a spring 19 is connected therebetween. The drive mechanism also includes a pair of right and left upper flipper shafts 23 and a pair of right and left lower flipper shafts 24 which are rotatably mounted on the bottom plate 8 through shaft portions 21 and 22 respectively. The shaft portions 21 and 22 of the upper and lower flipper shafts 23 and 24 are respectively inserted in holes of the upper and lower flippers 5*a* and 5*b*. In this case, as shown in FIG. 3B, the stepped portions formed on the shaft portions and those in the holes of the flippers mesh with each other, which makes it possible to integrally rotate the upper and lower flippers 5*a* and 5*b*.

Each of the flipper levers 20 is supported on the main body 7 by a lever pressing frame 25. One end of each flipper lever 20 projects from a side (opposing sides) of the main body 7 to be operated by the player. A pin 27 of each lower flipper shaft 24 is engaged with a cut-out 26 formed on the flipper lever 20. The upper flipper shafts 23 are connected to lower connecting bars 28 engaged with the holes thereof. Each connecting bar is engaged with a hole on an upper flipper shaft and also with a hole on the lower flipper shaft. With the above construction, when the flipper levers 20 are pressed, the lower flipper shafts 24, which are engaged with the flipper levers 20, are turned around the shaft portions 22. The lower flippers 5*b*, which are integrated with the shaft portions 22, are thus turned, which makes it possible for them to rebound the ball 4. At the same time, the upper flipper shafts 23, which are connected to the lower flipper shafts 24 through the connecting bars 28, are integrally turned. The upper flipper shafts 23 thereby turn upper flippers 5*a* in a forward direction. In addition, the discharging lever 2 connected at one end with a spring 29 is contained in the lever pressing frame 25. The discharging lever 2 protrudes from the upper surface of the main body 7 at the right corner portion on this side for discharging the ball 4 by the bias force of the spring 29.

Figure 2:
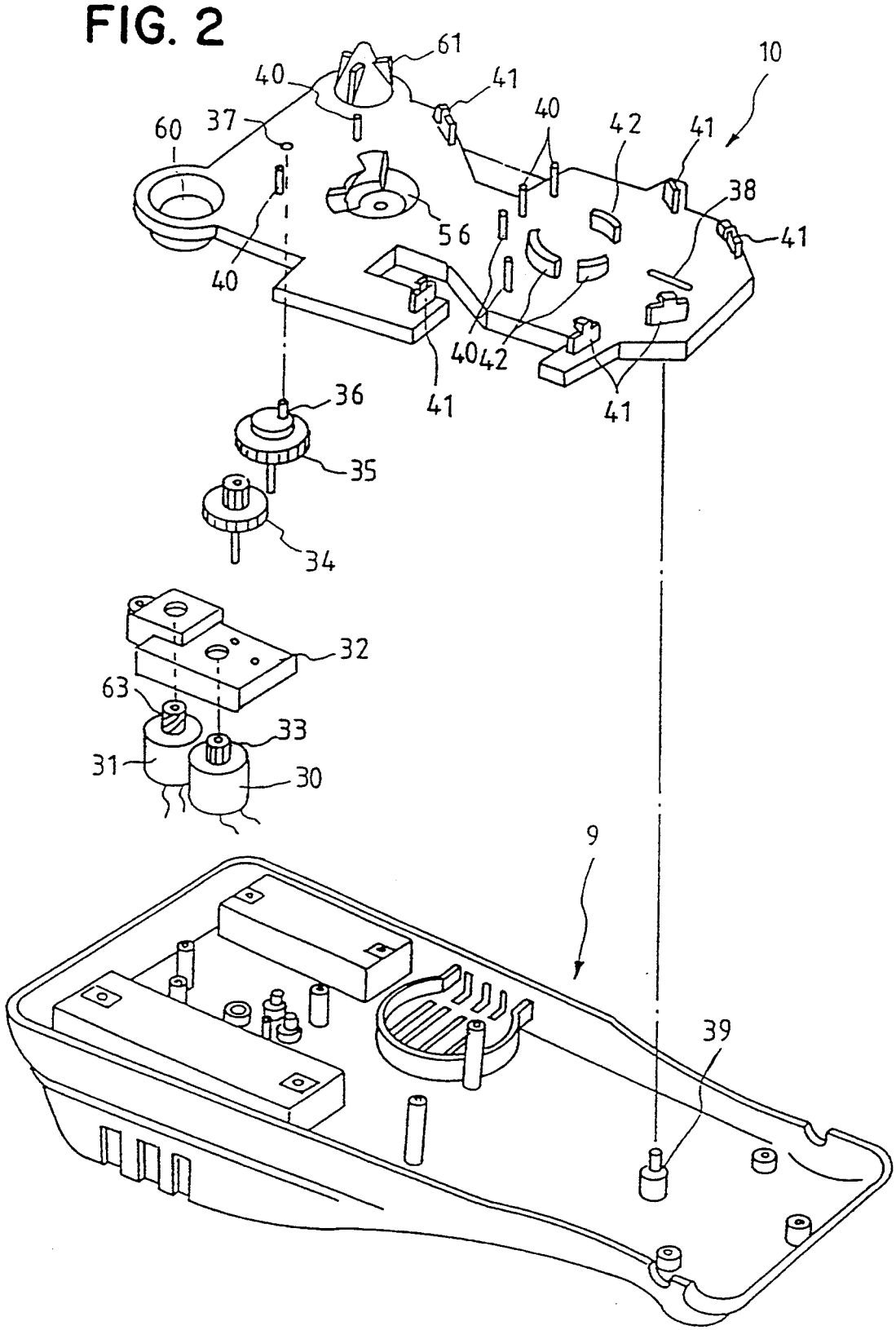
FIG. 2 is an exploded perspective view of a base, a rocking plate and associated elements.

As shown in FIG. 2, a motor 30 for rocking the rocking plate 10 and a motor 31 for operating the counter 6 are mounted on the base 9 by a mounting frame 32. Motors 30 and 31 are directed upward away from base 9. Two gears 34 and 35 are sequentially meshed with a pinion 33 of the motor 30, and a pin 36 is eccentrically provided on the upper surface of the gear 35. The pin 36 is engaged with a hole 37 formed at the central portion of the rocking plate 10 on the side which is away from the side where the ball 3 is discharged. On the other hand, a guide slot 38 extending in the longitudinal direction is formed at the central portion of the rocking plate 10 on a side which is opposite the hole 37 (towards where ball 4 is discharged) the guide slot 38 is engaged with a pin 39 projectingly provided on the base 9.

The rocking plate 10 is made of, for example, plastic. As shown in FIG. 2, six pins 40, six bumpers 41 and three lucky zone bumpers 42 are projectingly provided on the upper surface of the rocking plate 10. These pins 40, bumpers 41 and lucky zone bumpers 42 respectively pass through holes formed in both the bottom plate 8 and the surface layer plate 11 of the main body 7 to extend upwardly from the surface layer plate. The holes allow suitable clearance (have gaps) to account for movement of rocking plate 10. With this construction, when the ball 4 collides with these pins 40, bumpers 41 and lucky zone bumpers 42, the ball 4 is rebounded by the rocking action of the rocking plate 10.

Each pin 40 is made of a conductive metal material. The lower ends of the pins 40 are fixedly buried in the rocking plate 10. As shown in FIG. 7, each bumper 41 has a plastic rectangular supporting plate 43 formed integrally with the rocking plate 10 and a metal contact plate 44 mounted on the supporting plate 43. The lucky zone bumpers 42 are intended to define a circular lucky zone 46 (see FIG. 6) on the game board 3 together with surrounding walls 45 formed integrally with the bottom plate 8 of the main body 7. These lucky zone bumpers 42 and the surrounding walls 45 are positioned such that gaps exist there between to allow the ball 4 to pass therethrough. Each lucky zone bumper 42 has a plastic circular-arc supporting plate 47 formed integrally with the rocking plate 10. Two of the supporting plates 47 on this side are each mounted with metal contact plates 48 (see FIG. 6).

Figure 5:
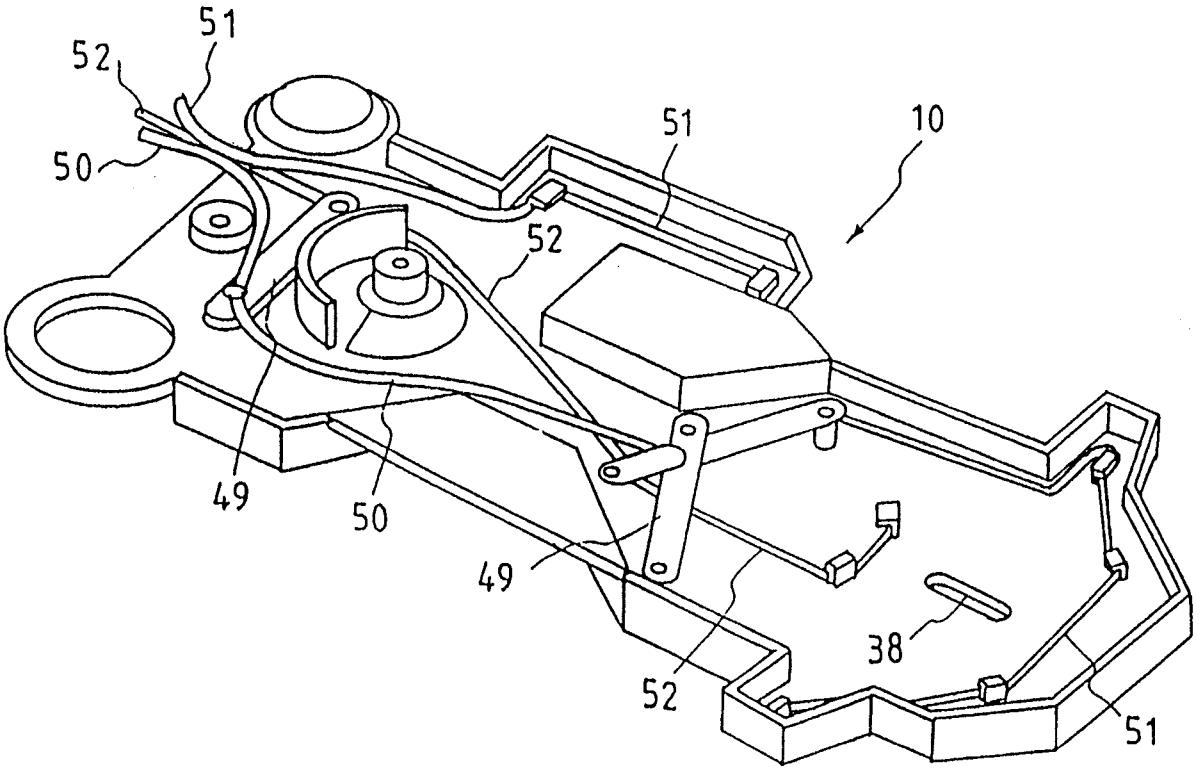
FIG. 5 is a perspective view showing a connecting structure on the back surface of the rocking plate.

As shown in FIG. 5, connections are made between the pins 40, between the contact plates 44 of the bumpers 41, and between the contact plates 48 of the lucky zone bumpers 42. The connections are made on the back surface of rocking plate 10 and are made by a connecting cord 50, a connecting cord 51 and a connecting cord 52, respectively. Metal plates 49 aid in the connections. The connecting cords 50, 51 and 52 partially constitute each of a counter circuit, a voice generation circuit and a light generation circuit (not shown). These circuits also include a power supply. The cords 50, 51 and 52 are intended to energize the pins 40, the contact plates 44 and the contact plates 48, respectively.

The surface layer plate 11 is a conductive metal plate, for example an iron plate. The surface layer plate 11 is also part of the counter circuit, the voice generation circuit and the light generation circuit. The surface layer plate 11 is energized with a polarity different from that of the pins 40 and contact plates 44 and 48. Portions of upper surface of the surface layer plate 11 are coated with a decorative paint Of a specified design. However, non-coated portions 64, adjacent to the pins 40, the bumpers 41 and the lucky zone bumpers 42 of the rocking plate 10 are not coated.

Figure 6:
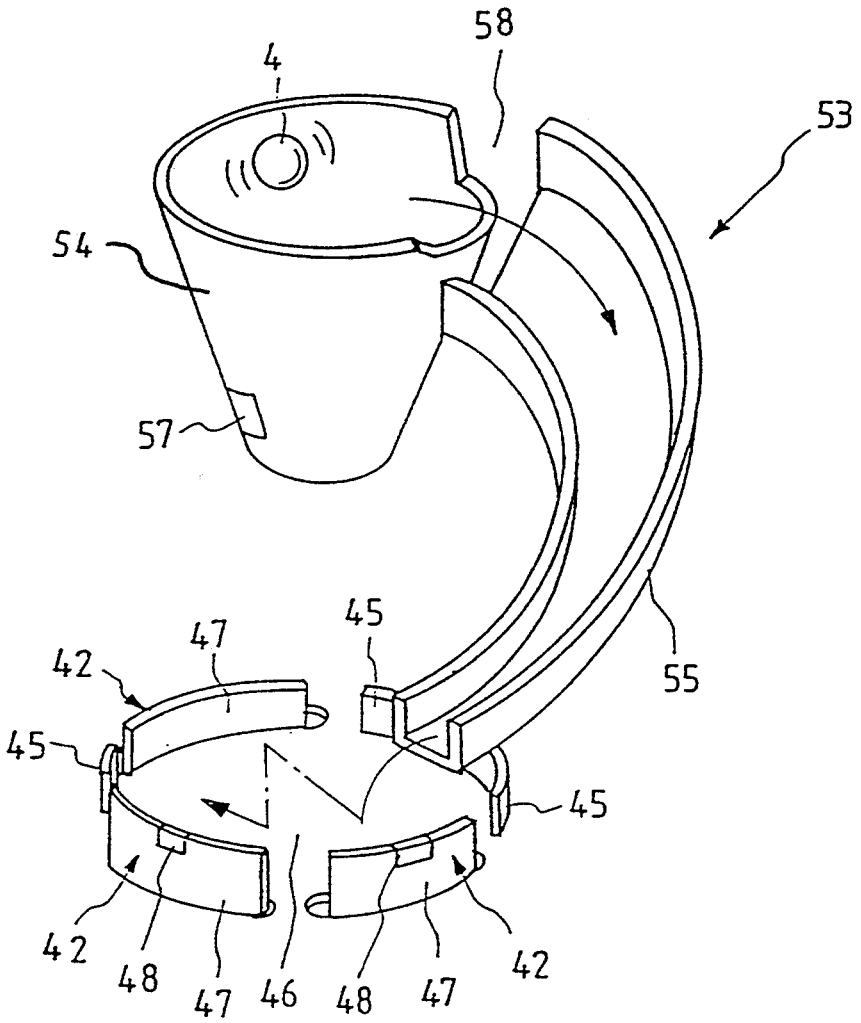
FIG. 6 is a perspective view of a jumping mechanism for moving a ball.
Figure 7:
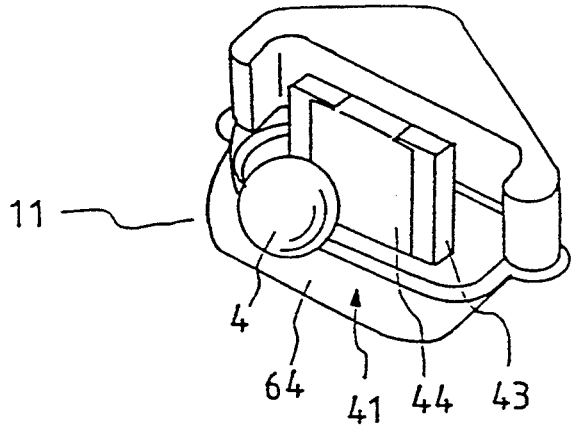
FIG. 7 is a perspective view showing a ball colliding with a bumper.

As shown in FIG. 6, a jumping mechanism 53 for jumping the ball 4 is provided at the center of the game board 3 on the side opposite where the ball 4 is discharged. The jumping mechanism 53 has a conical member 54 and a ball passage 55. The conical member 54 has a lower end portion screwed in the bottom of a mounting hole 56 formed on the rocking plate 10. The conical member 54 also has an upper half portion which projects upwardly from the bottom plate 8 and the surface layer plate 11 of the main body 7. In addition, a prism label (not shown) for generating the operative light is located on the inner surface of the rear wall of the mounting hole 56.

As shown in FIG. 6, an opening which serves as a ball inlet 57 is formed on the central portion on the side most distant from where the ball 4 is released from the conical member 54. On the other hand, the upper end portion of the side wall of the conical member 54 is partially cut-out to serve as a ball outlet 58. On the bottom plate 8 (see FIG. 4) of the main body 7, a guide groove 59 for guiding the ball 4 to the ball inlet 57 is formed at a position adjacent to the ball inlet 57. The ball passage 55 is formed of, for example, a transparent plastic and has a trough shape. The ball passage 55 is inclined such that one end (upper end) faces the ball outlet 58 and the other end (lower end) faces the lucky zone 46. In addition, the transparent cover 12 has a spherical dome portion 62 positioned to accommodate the conical member 54 (see FIG. 1). Reference numeral 60 in FIG. 2 indicates a recessed portion for temporarily holding the ball 4 dropped therein and then feeding it onto the game board 3. Reference numeral 61 represents a blade portion projectingly formed to irregularly rebound the ball 4 which collides therewith.

The operation of the pinball game device 1 having the above construction will now be described. First, when the main switch 15 is turned on, the motor 30 for driving the rocking plate 10 is rotated. Through rotation of the motor 30, the rocking plate 10 is rocked. Pins 36 and 39 serve to guide rocking plate 10, as the hole 37 is engaged with the eccentrically rotating pin 36 and slot 38 is engaged with the pin 39 of the base 9. The rocking plate 10 is thus reciprocated at a constant period and stroke in the longitudinal and the lateral directions with respect to the game board 3, and is rocked as a whole. Along with the rocking of the rocking plate 10, the pins 40, bumpers 41, lucky zone bumpers 42, conical member 54, recessed portion 60 and blade portion 61, which are all fixed on the rocking plate 10, are also rocked with respect to the game board 3. Further, when the main switch 15 is turned on, the pins 40, bumpers 41, lucky zone bumpers 42 and surface layer plate 11, as parts of the counter circuit, voice generation circuit and light generation circuit, are energized. The surface layer plate 11 is energized with a different polarity than the pins 40, bumpers 41 and lucky zone bumpers 42.

In such a state, when being discharged by the discharging lever 2, the ball 4 advances forward along the game board 3 and is possibly dropped in the recessed portion 60. The ball 4 is then returned to the game board 3 due to the centrifugal force and may be rebounded in an unexpected direction by the blade portion 61, and is rolled on this side along the game board 3. The bass 4 can be intentionally rebounded forward by a player with the flippers 5*a* and 5*b*, and may collide with the pins 40 and the bumpers 41 projecting from the game board 3. Pins 40 and bumpers 41 rock with respect to the game board 3, to thus automatically rebound ball 4.

Figure 8:
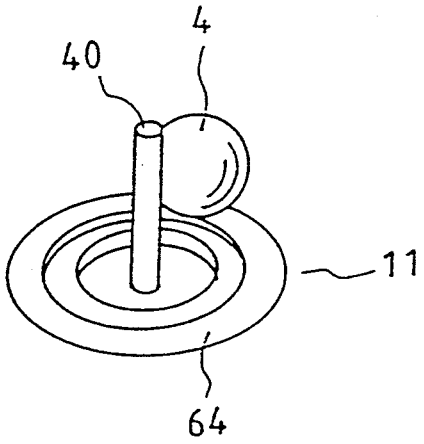
FIG. 8 is a perspective view showing a ball colliding with a pin.

In collision with the pins 40 and the bumpers 41, as shown in FIGS. 7 and 8, the steel ball 4 contacts pins 40 or contact plates 44 of the bumpers 41 and also simultaneously contacts the non-coated portions 64 of an adjacent portion of the surface layer plate 11. Thus, electrical conduction can occur. As a result of the conduction, the motor 31 is rotated to actuate the counter circuit, so that the counter 6 counts a score, for example one point, by means of a mechanical counter drive mechanism (not shown) meshing with a worm gear 63 of the motor 31. At the same time, the voice generation circuit and the light generation circuit are actuated to generate a specified operative sound and operative light. Thus, whenever the ball 4 collides with the pin 40 or the bumper 41 point(s) are scored, light is emitted and sounds are produced.

When the ball passes the ball inlet 57 of the conical member 54, the ball 4 is guided by the guide groove 59 formed on the bottom plate 8 of the main body 7, to enter the ball inlet 57 of the conical member 54. The ball 4, when in the conical member 54, is subjected to a centrifugal force from the rocking conical member 54. Thus, as shown in FIG. 6, the ball 4 is rolled and raised along the inner surface of the wall of the conical member 54, to be eventually be flung away from the ball outlet 58 to exit the conical member 54. There is some probability that the ball 4 exiting will be received in the ball passage 55. In this case, the ball 4 will be fed to the lucky zone 46.

The ball 4 fed to the lucky zone 46 is repeatedly rebounded by the rocking lucky zone bumpers 42 until it is discharged from the lucky zone 46 through the gaps between lucky zone bumpers 47 and surrounding walls 45. As described above, the contact plates 48 provided on the two lucky zone bumpers are energized just as are the pins 40 and the contact plates 44 of the bumpers 41. Thus, whenever the ball 4 collides with the lucky zone bumpers 42, the score is incremented and the operative sound and operative light are produced. Accordingly, when the ball 4 enters the lucky zone 46, a high score can be obtained (because of the repeated collisions). In addition, the dimensional and positional relationships between the ball outlet 58 and the ball passage 55 determine the probability that the ball 4 flung away from the ball outlet 58 of the conical member 54 will be received by the ball passage 55 and deposited into the lucky zone 46. Consequently, by adjusting the dimensional and positional relationships, the probability that the ball 4 will enter the lucky zone 46 can be adjusted. This controls the difficulty in scoring.

As described above, in this embodiment, the ball 4 moving along the game board 3 can enter the conical member 54 from the ball inlet 57 to be rolled and raised along the inner surface of the conical member 54 by the centrifugal force of the rocking conical member 54. The ball 4 is eventually flung away from the ball outlet 58 to the outside and may pass through the ball passage 55 to be deposited in the lucky zone 46. Accordingly, a player enjoys playing the game while visually enjoying the jumping movement, that is, the three-dimensional movement, of the ball 4. Further, as described above, when the ball 4 enters the lucky zone 46, a high score can be easily obtained. Thus, the player can watch the jumping movement of the ball 4 while expecting a high score, and accordingly can enjoy the game more fully.

In addition, the present invention can be embodied in various modes without limitation to the above-described embodiment. For example, a description has been made with regard to a pinball game device. However, the present invention can, of course, be applied to other suitable ball game devices, and to game devices not employing balls, such as a game in which a short column-shaped movable body is slid along a game board. The present invention may also be applied to a large pinball game device in addition to the small table top model described above. The details of the construction may be further variously modified without departing from the spirit or scope of the present invention as recited in the appended claims.

As described above, the game device of the present invention allows one to visually enjoy the movement of a movable body while ensuring amusement in the game. This is done by moving the movable body in three dimensions along the game board.

I claim:

1. An amusement device comprising:

a movable body;

a game board having a surface large enough to accommodate movement of the movable body in a plane of movement, said surface having first and and second play areas;

jumping means for moving the movable body out of the plane of movement and moving the movable body from the first play area to the second play area;

a conical member having upper and lower portions, the conical member being positioned within the first play area with the lower portion being closer to the game board than the upper portion, the conical member having a movable body outlet in the upper portion and a movable body inlet in the lower portion;

a sloped movable body passage having first and second ends, the first end being positioned in the vicinity of the movable body outlet, the second end being positioned in the vicinity of the second play area; and movement means for moving the movable body from the movable body inlet to the movable body outlet.

2. An amusement device according to claim 1, further comprising a guide groove for guiding the movable body from the game board to the movable body inlet.

3. An amusement device according to claim 1, wherein there is a gap between the movable body outlet and the movable body passage.

4. An amusement device according to claim 1, wherein the movement means comprises:

a rocking plate positioned on a side of the game board opposite the plane of movement, the lower portion of the conical member extending through a hole in the game board which allows clearance between the game board and the conical member, the lower portion of the conical member being attached to the rocking plate; and rocking means for reciprocating the rocking plate in at least first and second directions.

5. An amusement device according to claim 4, wherein the rocking means reciprocate in a generally circular motion.

6. An amusement device comprising:

a movable body;

a game board having a surface large enough to accommodate movement of the moveable body in a plane of movement;

a conical member having upper and lower portions, the upper portion of the conical member extending out of the game board, through the plane of movement, the conical member having a movable body inlet in the lower portion;

a rocking plate positioned on a side of the game board opposite the plane of movement, the lower portion of the conical member extending through a hole in the game board which allows clearance between the game board and the conical member, the lower portion of the conical member being attached to the rocking plate; and rocking means for reciprocating the rocking plate in at least first and second directions so that when the movable body enters the movable body inlet of the conical member a centifugal force is created to discharge the movable body from the upper portion of the conical member, the rocking means including a driving source linked to an eccentric cam, the eccentric cam engaging the rocking plate.

* * * * *

UNITED STATES PATENT AND TRADEMARK OFFICE

CERTIFICATE OF CORRECTION

PATENT NO. : 5,362,050

DATED : November 8, 1994

INVENTOR(S) : Yasushi MATSUYAMA

It is certified that error appears in the above-indentified patent and that said Letters Patent is hereby corrected as shown below:

Col. 4, line 60, change "Of" to --of--.

Col. 8, line 38, after "member" add --,--.

Signed and Sealed this

Twenty-eight Day of February, 1995

Bruce Lehman

*Attest:*

BRUCE LEHMAN

*Attesting Officer*

*Commissioner of Patents and Trademarks*